United States Patent [19]

Baumann

[11] Patent Number: 5,069,378

[45] Date of Patent: Dec. 3, 1991

[54] PAPER DISPENSER

[75] Inventor: Manfred Baumann, Diepoldsau, Switzerland

[73] Assignee: Metsä-Serla Oy, Helsinki, Finland

[21] Appl. No.: 358,781

[22] Filed: Mar. 15, 1989

Related U.S. Patent Documents

[63] Continuation-in-part of PCT/SE88/00372 Jul. 8, 1988.

[30] Foreign Application Priority Data

Jul. 15, 1987 [SE] Sweden ..... 8702872

[51] Int. Cl.[5] ..... A47K 10/36; B65D 85/674

[52] U.S. Cl. ..... 225/1; 225/52; 225/72; 225/91

[58] Field of Search ..... 225/52, 72–75, 225/88, 90, 91, 1, 4

[56] References Cited

U.S. PATENT DOCUMENTS

| | | | |
|---|---|---|---|
| 444,106 | 1/1891 | Spraker | 225/75 |
| 1,653,298 | 12/1927 | Leidecker . | |
| 2,032,643 | 3/1936 | Westbo | 242/55.5 |
| 2,817,404 | 12/1957 | Vogt | 164/84.5 |
| 3,273,773 | 9/1966 | Eder | 225/74 |
| 4,516,711 | 5/1985 | Barege | 225/74 |
| 4,579,266 | 4/1986 | Bunger | 225/91 |
| 4,586,639 | 5/1986 | Ruff et al. | 225/72 |
| 4,826,063 | 5/1989 | Ban | 225/52 |

FOREIGN PATENT DOCUMENTS

| | | | |
|---|---|---|---|
| 2351699 | 4/1975 | Fed. Rep. of Germany . | |
| 3406880 | 9/1985 | Fed. Rep. of Germany . | |
| 3502723 | 10/1985 | Fed. Rep. of Germany . | |
| 342031 | 8/1936 | Italy | 225/72 |
| 196912 | 6/1965 | Sweden . | |
| 616578 | 4/1980 | Switzerland . | |

*Primary Examiner*—Hien H. Phan

*Attorney, Agent, or Firm*—Nils H. Ljungman & Associates

[57] ABSTRACT

A paper dispenser is furnished with one or more turnable or tiltable cutting or tearing off device, equipped with serrated or jagged edges. When inactive, the cutting edge is held by a spring or by force of gravity in a safe or innocuous position. As a drawing force is applied to the paper web coming out of the dispenser, the cutting or tearing off device is turned or tilted so that the serrations of the cutting edge come into contact with the paper web. When a portion of the web is torn off, the jagged edge returns to its shielded position. The cutting or tearing off device can be directly actuated by the paper web, or via an intermediate element.

21 Claims, 2 Drawing Sheets

PAPER DISPENSER

CROSS REFERENCE TO RELATED APPLICATION

This application is a Continuation-in-Part Application of PCT application No. PCT/SE88/00372, filed on Jul. 8, 1988, in which the United States was a designated state.

BACKGROUND OF THE INVENTION

1. Field of the Invention

The invention is directed to a paper dispenser and more particularly to means for cutting or partitioning a paper web drawn out of the dispenser. As this cutting or partitioning means is formed with a jagged, serrated or zagged cutting edge, it is of importance to have the edge covered, when inactive or in a passive position, to prevent hand injuries to a person grasping at the paper web.

2. Description of the Prior Art

Paper dispensers of many shapes are known and, since long ago, designers have been engaged in finding paper dispenser means effective in cutting or partitioning a paper web, while avoiding injury to the user's hand. In case of round paper dispensers, where the paper web is drawn out of the center hole of a paper roll standing on its one end on a shelf or support constituting the bottom of the dispenser and having a central through-hole or aperture, there has been applied a circumferential serrated or zagged cutting edge. According to SE-C-389086 this solution spaces or distances the cutting edge from where the end of the paper web should be grasped. As a piece of paper has been torn off, the end of the paper web will be hanging down from the central through-hole or aperture of the dispenser long enough to be safely within reach adjacent the serrated or zagged edge.

In SE-B-430464, disclosed is the necessity to have a kind of protective collar outside the tearing off rim.

The above-mentioned patent applications are incorporated herein as if the entire contents thereof were fully set forth herein.

OBJECTS OF THE INVENTION

One object of the present invention is to provide a cutting or tearing off edge for a paper dispenser workable irrespective of whether the paper web is fed from the periphery of a roll, or twisted from the center hole of a roll. Furthermore, the cutting edge desirably will be kept in a shielded or covered position when not active in cutting the paper web.

SUMMARY OF THE INVENTION

To achieve these and other advantages, the present invention discloses certain novel features hereafter made obvious by the appended claims. According to one embodiment of the invention, the cutting edge, being serrated or zagged for easily separating in desired pieces even twisted paper web drawn out of the center hole of a paper roll, is turnable or tiltable from a covered or shielded position into an active or operative position. This movement is automatically achieved by drawing the paper web out of the dispenser. More specifically, when using an embodiment with the cutting or tearing off edge furnished along one border of a flat bar, which along its other border is hinged to the bottom or the housing of the dispenser, an intermediate element is displaced by the paper web and presses the cutting edge out to its active position. In this way, the cutting edge comes forward and contacts the paper web, which can then be torn off in a desired length. Thereafter, the bar returns by the aid of a spring, or due to the force of gravity, back to its passive or rest state with the edge covered or shielded from hand contact. One way to use the force of gravity is to have an arm or a lever, if necessary with a weight on, coupled to a bar. Another way to use the force of gravity is to have a weight placed on the hinge opposite to the bar itself.

In another embodiment of the invention, the cutting edge is secured to one of the flanges of a tiltable bar having a cross-section of L-, V-, or T-shape. As has been explained hereinbefore, to avoid injuries to a user of the dispenser, the cutting or tearing off edge lies covered when inactive. In this case, the paper web, when drawn out of the dispenser, touches a free flange or extremity of the bar and tilts this so that the cutting edge comes forward from its covered position into contact with the web. The tilting movement can be achieved by direct frictional contact between the paper web and a part of the bar. However, in some cases, it is preferred to insert an intermediate element to be horizontally displaced by the paper web, and thereby transmitting the force necessary to tilt the bar. By raking the intermediate element wedge-shaped a vertical movement of the tearing off edge can be brought about. As the paper web is torn off, the edge returns to its covered position, either due to the distribution of weight within the cross-section of the bar, or by way of a spring.

The embodiments of the dispenser hereinabove described might use only one cutting or tearing off means. However, for the person skilled in the art it is obvious to provide and arrange, vertically on a wall, a paper dispenser with more cutting edge means. This is particularly applicable to paper dispensers from which the paper web is fed out of the center hole of the roll, because when the roll is wound off peripherally one edge is enough.

In using two or more cutting edge means of any of the kinds described, it is considered an advantage to place an intermediate element under the outlet of the paper dispenser. This element is "free-floating" in the sense that when pulling the paper web in any direction, the intermediate element moves in the same direction and actuates one cutting or tearing off edge means, so that the edge contacts the paper web, making it possible to tear off a desired piece thereof.

The expression "free-floating" with respect to the intermediate element comprehends that it does not offer any resistance to the cutting edge means in their return to the passive or covered position, whether the return movement is carried out due to gravity force, or when a spring is involved.

On way to attain the "free-floating" of the intermediate element is have the walls of the housing of the paper dispenser extend beneath the bottom of the dispenser, and having the intermediate element slidably moving in recesses in the so formed flanges.

BRIEF DESCRIPTION OF THE DRAWINGS

A preferred embodiment of the invention will be described with reference to the accompanying drawings, in which.

DESCRIPTION OF THE PREFERRED EMBODIMENTS

Figure 1:
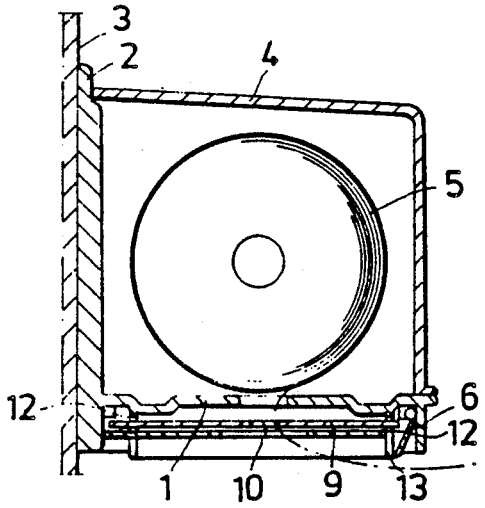
FIG. 1 is a vertical section of a paper dispenser attached to a wall and a horizontally placed paper roll, the web of which is drawn from its periphery.
Figure 2:
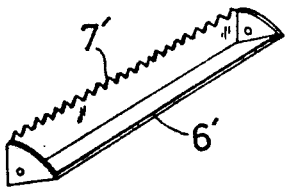
FIG. 2 is a perspective view of a cutting or tearing off means with zags or serrations formed at the edge of the one flange of a L-shaped bar.

FIG. 1 shows a paper dispenser composed of a bottom 1 integrated with a wall bracket 2, mounted to a vertical wall 3, and including a housing 4. Within the housing 4 hangs a horizontally disposed paper roll 5, parallel to the bottom 1. The paper dispenser could be in a form close to a cylinder, but it is considered an advantage to have at least the bottom 1 in an essentially square shape. By that configuration of the bottom 1, at least one straight cutting or tearing off means 6 is mounted adjacent an edge of the bottom 1.

Figure 3:
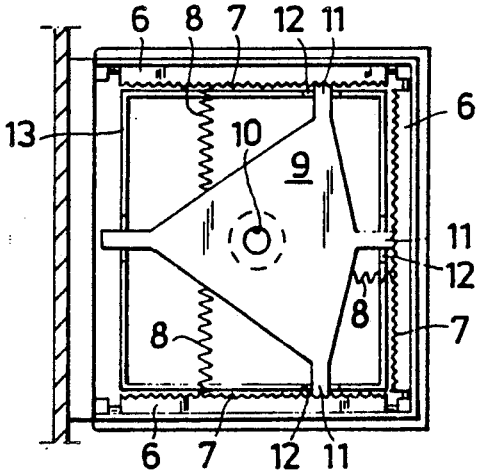
FIG. 3 is a bottom plan view of a paper dispenser without its bottom cover and illustrating a flat intermediate element for actuating the cutting or tearing off means.
Figure 4:
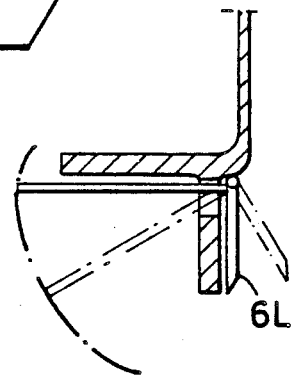
FIGS. 4–7 are examples, in cross-section, of L-, V-, T-and I-shaped tearing off or cutting means.

To enhance the use of the paper dispenser, the embodiment of FIG. 3 has been equipped with cutting or tearing off means 6 along three sides of the bottom 1. By this arrangement it is possible to draw out the paper web in any desired direction, and to have it cut off by the cutting or tearing off means 6. In order to cut the twisted paper web coming out of the center hole with a paper roll standing on the bottom 1, the tearing off means has been designed with a serrated or zagged edge 7. To have serrations or zags out of touch or in a safe position when the edge is not needed for a cutting or tearing off operation, the whole cutting or tearing off means 6 is turned or tilted into a position where the edge 7 is covered. The retraction or withdrawal of the tearing off means 6 from its active position is carried out by a spring 8. This spring keeps the cutting or tearing off means 6 in its rest state.

For the actuation of the cutting or tearing off means 6 into its active position, the paper dispenser is furnished with a flat element 9 placed beneath the bottom 1. This flat element 9 has a polygonal shape and a central hole 10. The hole 10 is by preference round, and of a diameter smaller than the diameter of the hole in bottom 1, through which the paper web is compacted by traverse constriction and fed or withdrawn. The flat element 9 can be moved horizontally, and the movement is caused by drawing the paper web to one side of the hole in bottom 1. As the paper web passes the hole 10 in the flat element 9 and is drawn to one side, the latter hole is shifted with that of the bottom 1. Thereby, the flat element 9 is displaced and tenons 11, formed at the corners or other locations on the periphery of the flat element 9, slides in recesses 12 in flanges 13 extending downwardly from the bottom 1.

Figure 5:
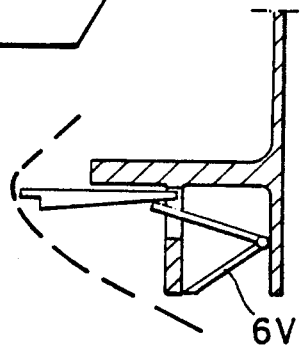
Figure 6:
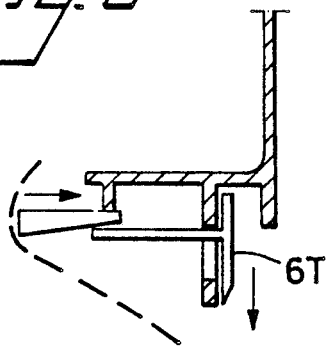

A tenon 11 protrudes through a recess 12 and presses against the cutting or tearing off means 6 causing this to tilt (FIGS. 5 and 6), to turn (FIG. 5) or just to lower (FIG. 6). As long as there is a force in the paper web, the flat element 9 will hold the cutting or tearing off means 6 with its edge 7 out in its active position, but immediately after the paper web has been torn off the spring 8 will bring back the cutting or tearing off means 6 with its serrated or zagged edge 7 to its covered position. Thus the risk of injuries to the next person grasping at the end of the paper web is avoided.

Figure 7:
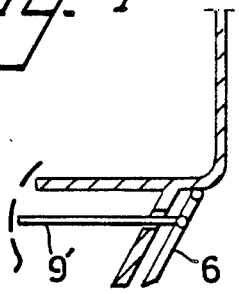

In the case of a flat cutting or tearing off means 6 (FIG. 7) hinged to the bottom 1, the intermediate element 9 is permanently connected to at least one end of the bar in such a manner that a short displacement of the intermediate element 9 results in a movement of the edge 7 of a multiplied distance.

Figure 8:
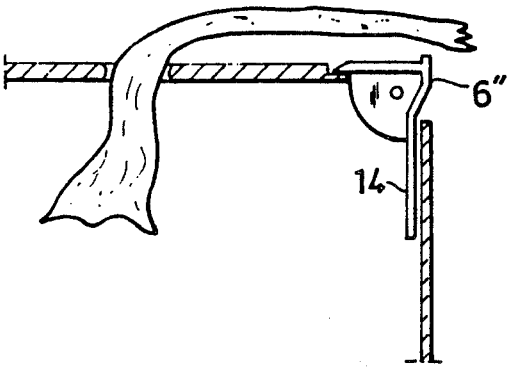
FIG. 8 is a fragmentary, vertical section of a top feeding dispenser with a cutting or tearing off means designed with a lever and shown in its inactive, passive or rest position.
Figure 9:
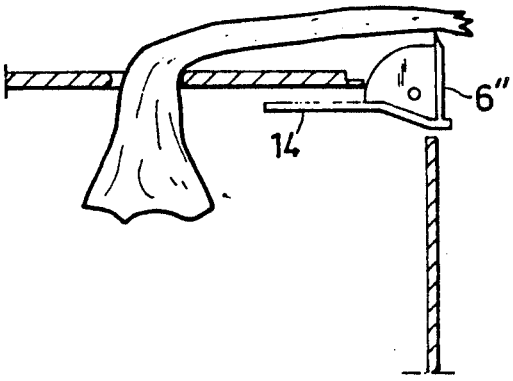
FIG. 9, the same view as in FIG. 8, but with the edge in its active or operative position.

The embodiment of FIGS. 8 and 9 is intended for paper dispensers used standing on the floor or on a bench. In this case advantage is taken of the force of gravity. Thus, a lever 14, of the cutting or tearing off means 6″, keeps the edge thereof in an innocuous or safe position. When pulling the paper web out of the dispenser, the friction between the paper and the tearing off means 6″ brings the latter to turn and raise the lever 14. As soon as the paper web is torn off, the lever 14 falls down and brings the edge back to its covered position. The lever 14 can be fitted with a displaceable weight for adjustment of its reaction to the friction force between the paper web and the tearing off means 6″.

One aspect of the invention resides broadly in a paper dispenser comprising a cutting assembly on the dispenser for cutting a paper web into desired pieces; an aperture on the dispenser for withdrawing a paper web from the dispenser; an actuating mechanism adjacent the aperture for engaging the paper web during the withdrawal; the actuating mechanism adjacent the aperture being constructed and arranged to move the cutting assembly from a passive position, out of contact with the paper web, into an operative position, in contact with the paper web, for cutting a desired piece.

Another aspect of the invention resides broadly in a paper dispenser, wherein the actuating mechanism includes aperture of a size smaller than the aperture on the dispenser and alignable with the aperture on the dispenser, the actuating mechanism being constructed and arranged to be movable in a selected direction to actuate the cutting assembly into the operative position.

Yet another aspect of the invention resides broadly in a paper dispenser, wherein the actuating mechanism is a flat member of polygonal shape having tenons on its periphery that are slidable in recesses carried on the dispenser, the tenons being arranged to actuate the cutting assembly into the operative position.

A further aspect of the invention resides broadly in a paper dispenser, wherein the cutting assembly has a support apparatus comprising a bar member pivotable around an axis in its longitudinal direction.

A yet further aspect of the invention resides broadly in a paper dispenser, wherein the cutting assembly comprises a cutting edge on the support apparatus.

Yet another further aspect of the invention resides broadly in a paper dispenser, wherein the cutting assembly has a support apparatus comprising a bar member mounted for vertical movement.

An additional aspect of the invention resides broadly in a paper dispenser, which includes biasing mechanism for the actuating mechanism tending to maintain the aperture in alignment.

A yet additional aspect of the invention resides broadly in a paper dispenser, wherein the cutting edge is serrated.

A further additional aspect of the invention resides broadly in a paper dispenser comprising a cutting assembly adjacent an outlet of the dispenser for cutting a paper web into desired pieces; support apparatus for the cutting assembly; and actuating mechanism for the support apparatus; the actuating mechanism being constructed and arranged to be engaged by and responsive to movement of the paper web to move the support apparatus and thereby move the cutting assembly from a passive position, out of contact with the paper web, into an operative position, in contact with the paper web, for cutting a desired piece.

A yet further additional aspect of the invention resides broadly in a paper dispenser, wherein the outlet comprises an aperature of a size smaller than the width of the paper web.

Another further additional aspect of the invention resides broadly in a paper dispenser, wherein the actuating mechanism includes an aperture of a size smaller than the aperture comprising the dispenser outlet and alignable with the latter aperture, the actuating mechanism being constructed and arranged to be movable in a selected direction to actuate the cutting assembly into the operative position.

A yet another additional aspect of the invention resides broadly in a paper dispenser, wherein the actuating mechanism is a flat member of a polygonal shape having tenons on its periphery that are slidable in recesses carried on the dispenser, the tenons being arranged to activate the cutting assembly into the operative position.

Another yet further aspect of the invention resides broadly in a paper dispenser, wherein the cutting assembly has a support apparatus comprising a bar member pivotable around an axis in its longitudinal direction.

A still further aspect of the invention resides broadly in a paper dispenser, wherein the cutting assembly has a support apparatus comprising a bar member mounted for vertical movement.

A still further additional aspect of the invention resides broadly in a paper dispenser, which includes biasing mechanism for the actuating mechanism tending to maintain the aperture in alignment.

Another still further aspect of the invention resides broadly in a method of dispensing a paper web and cutting the paper web into desired pieces which comprises withdrawing the paper web from the dispenser; contemporaneously engaging the paper web in contact with an actuating mechanism for a web cutting assembly; moving the actuating mechanism by the contact to thereby move the web cutting assembly from a passive position, out of contact with the paper web, into an operative position, in contact with the paper web, for cutting a desired piece; and cutting off the desired piece from the web.

The invention as described hereinabove in the context of a preferred embodiment is not to be taken as limited to all of the provided details thereof, since modifications and variations thereof may be made without departing from the spirit and scope of the invention.

What is claimed is:

1. A method of dispensing a paper web from a dispenser and cutting the paper web into desired pieces comprising the steps of:

withdrawing a paper web from a dispenser and contemporaneously engaging said paper web in contact with an actuating means for a web cutting means;

moving said actuating means by said contact to thereby move said web cutting means from a passive position, out of contact with said paper web, into an operative position, in contact with said paper web, for cutting a desired piece;

cutting off a desired piece from said paper web; and withdrawing said paper web by passing said paper web through a web constricting aperture to thereby compact said paper web transversely.

2. The method of dispensing a paper web according to claim 1, which includes moving said actuating means horizontally.

3. The method of dispensing a paper web according to claim 1, which includes moving said actuating means and said cutting means arcuately.

4. The method of dispensing a paper web according to claim 1, which includes retracting said actuating means to its initial position after cutting off said desired piece from said web.

5. A paper dispenser having cutting apparatus for tearing a paper web into pieces, the paper dispenser having a paper dispenser outlet for dispensing the paper web from the dispenser, the cutting apparatus being actuated to an operative position upon the application of a pulling force to the paper web to dispense the paper web from the dispenser, the cutting apparatus being engageable by the paper web to tear the paper web upon actuation of the cutting apparatus to the operative position, the cutting apparatus being movable to a covered and passive position out of engagement with the paper web upon removal of the pulling force from the paper web, said paper dispenser comprising:

a movable element positioned adjacent the paper dispenser outlet;

said movable element having an opening through which the paper web is dispensed;

said movable element opening being of a smaller dimension than a dimension of the paper dispenser outlet;

said movable element opening being alignable with the paper dispenser outlet;

said movable element opening comprising a web constricting aperture for compacting the paper web transversely;

said movable element being engageable by the paper web upon the application of the pulling force to the paper web;

said movable element having a surface;

said movable element surface having a plane;

said movable element surface being movable in at least one direction generally parallel to said plane upon initial application of the pulling force to the paper web during dispensing; and movement of said movable element in said at least one direction generally parallel to said plane actuating the cutting apparatus to the operative position to tear the paper web.

6. The paper dispenser according to claim 5, wherein:

said movable element has a polygonal configuration;

said movable element includes tenons extending from said polygonal configuration;

said paper dispenser has walls having recesses;

said tenons are slidable in said recesses; and said tenons are configured to actuate the cutting apparatus to the operative position upon the application of the pulling force to the paper web.

7. The paper dispenser according to claim 6, wherein said movable element is biased to the covered and passive position by at least one spring upon the removal of the pulling force from the paper web.

8. The paper dispenser according to claim 7, wherein:

said cutting apparatus includes a generally flat bar having zags along one edge;

said bar is hinged at an edge opposite the edge having said zags; and said bar is movable on the hinge to move said cutting apparatus between said operative and passive positions by a linkage, said linkage being connected between said bar and said movable element.

9. A paper dispenser comprising:

a frame;

said frame having aperture means for withdrawing a paper web therethrough and from the dispenser;

cutting means for cutting the paper web;

said cutting means being movably connected to said frame;

movable actuating means for moving said cutting means from a passive position out of contact with the paper web, to an operative position in contact with the paper web to cut the paper web;

said actuating means being movably connected to said frame;

said actuating means being positioned adjacent said frame aperture means;

said actuating means being engageable and movable by the paper web during dispensing, to move said cutting means from said passive position to said operative position to cut the paper web, upon withdrawal of the paper web from the paper dispenser;

said actuating means having an opening;

said actuating means opening being of a smaller size than said frame aperture means;

said actuating means opening being alignable with said frame aperture means; and said actuating means opening comprising web constricting means for compacting the paper web transversely.

10. The paper dispenser according to claim 9, wherein:

said actuating means is generally flat;

said actuating means has a polygonal shape;

said actuating means has peripheral tenons extending from said polygonal shape;

said frame has recesses;

said tenons are slidable in said recesses; and said tenons are configured to move said cutting means to said operative position to cut the paper web upon withdrawal of the paper web from the paper dispenser.

11. The paper dispenser according to claim 10, wherein:

said cutting means has a support; and said support has a bar pivotable about its longitudinal axis.

12. The paper dispenser according to claim 11, wherein said cutting means includes a cutting edge on said support.

13. The paper dispenser according to claim 12, further including biasing means for biasing said actuating means relative to said frame.

14. The paper dispenser according to claim 13, wherein said cutting edge is serrated.

15. The paper dispenser according to claim 10, wherein:

said cutting means has a support; and said support has a vertically movable bar.

16. A paper dispenser having a paper dispensing outlet, said paper dispenser comprising:

cutting means for cutting a paper web into pieces;

said cutting means being positioned adjacent the paper dispensing outlet;

support means for moving said cutting means;

actuating means for moving said support means;

said paper dispensing outlet being disposed on said actuating means;

said actuating means being engageable and movable by paper being dispensed through the paper dispensing outlet;

said support means being movable by said actuating means, to move said cutting means from a passive position out of contact with the paper web to an operative position in contact with the paper web to cut the paper web, upon movement of said actuating means by paper being dispensed through the paper dispensing outlet;

the paper dispensing outlet having an opening; and the paper dispensing outlet opening being of a smaller size than the width of the paper web being dispensed through the paper dispensing outlet; and the paper dispensing outlet opening having constricting means for compacting the paper web transversely.

17. The paper dispenser according to claim 16, wherein:

said actuating means has an aperture of a smaller size than the paper dispensing outlet opening; and said aperture is alignable with the paper dispensing outlet opening.

18. The paper dispenser according to claim 17, further including biasing means for biasing said aperture means in alignment with the paper dispensing outlet opening.

19. The paper dispenser according to claim 16, wherein:

said actuating means is generally flat;

said actuating means has a polygonal shape;

said actuating means has peripheral tenons extending from said polygonal shape;

said paper dispenser has walls having recesses;

said tenons are slidable in said recesses; and said tenons are configured to move said cutting means into said operative position to cut the paper web upon movement of said actuating means by paper being dispensed through the paper dispensing outlet.

20. The paper dispenser according to claim 16, wherein said cutting means has a bar pivotable about its longitudinal axis.

21. The paper dispenser according to claim 16, wherein:

said cutting means has a support; and said support has a vertically movable bar.

* * * * *

UNITED STATES PATENT AND TRADEMARK OFFICE

CERTIFICATE OF CORRECTION

PATENT NO. : 5,069,378

DATED : December 3, 1991

INVENTOR(S) : Manfred BAUMANN

It is certified that error appears in the above-identified patent and that said Letters Patent is hereby corrected as shown below:

In column 2, line 27, after 'By', delete "raking" and insert --making--.

In column 2, line 28, after 'wedge-shaped', insert --,--.

Signed and Sealed this

Twentieth Day of April, 1993

*Attest:*

MICHAEL K. KIRK

*Attesting Officer*

*Acting Commissioner of Patents and Trademarks*